US005237921A

United States Patent [19]

Grundke

[11] Patent Number: 5,237,921

[45] Date of Patent: Aug. 24, 1993

[54] DEVICE FOR ADJUSTING THE CIRCUMFERENTIAL REGISTER OF A PRINTING MACHINE

[75] Inventor: Edgar Grundke, Mannheim, Fed. Rep. of Germany

[73] Assignee: Heidelberger Druckmaschinen AG, Heidelberg, Fed. Rep. of Germany

[21] Appl. No.: 979,836

[22] Filed: Nov. 23, 1992

[30] Foreign Application Priority Data

Nov. 21, 1991 [DE] Fed. Rep. of Germany ..... 4138271

[51] Int. Cl.[5] ..... B41F 13/12; B41L 35/04

[52] U.S. Cl. ..... 101/248

[58] Field of Search ..... 101/248, 181, 216, 219, 101/485, 486, 286, DIG. 36

[56] References Cited

U.S. PATENT DOCUMENTS 3,610,064 10/1971 Kaneko .
4,085,674 4/1978 Biggar ..... 101/248

FOREIGN PATENT DOCUMENTS 1077231 9/1960 Fed. Rep. of Germany .
1290941 9/1969 Fed. Rep. of Germany .
1943579 12/1971 Fed. Rep. of Germany .
1611195 4/1974 Fed. Rep. of Germany .
1128644 9/1968 United Kingdom .

*Primary Examiner*—J. Reed Fisher

*Attorney, Agent, or Firm*—Herbert L. Lerner; Laurence A. Greenberg

[57] ABSTRACT

A device for adjusting the circumferential register of a printing machine includes a gearwheel for driving a cylinder disposed coaxially therewith. Adjusting elements are connected to the gearwheel in angular position thereof for turning the gearwheel, during operation of the printing machine, over a defined angle relative to the cylinder about the common axis thereof. An adjusting device is located outside the gearwheel and is shiftable in axial direction. The adjusting device is coupled to the adjusting elements connected to the gearwheel. The adjusting elements connected to the gearwheel include at least one two-armed angle lever having a swivel axis disposed perpendicularly to the axis of the cylinder at a defined distance therefrom. The angle lever has first and second legs, the first leg being swivellably connected to the cylinder via a connecting rod at a connection location movable in tangential direction relative to the gearwheel. A cam roller is fastened to an end of the second leg. The cam roller has an axis of rotation extending perpendicularly to the axis of the cylinder. The adjusting device located outside the gearwheel includes a shifting wheel having a groove disposed outside the gearwheel in the form of an adjusting device. The contact surface of the cam roller abuts against a radial lateral surface of the groove.

2 Claims, 1 Drawing Sheet

DEVICE FOR ADJUSTING THE CIRCUMFERENTIAL REGISTER OF A PRINTING MACHINE

Figure 1:
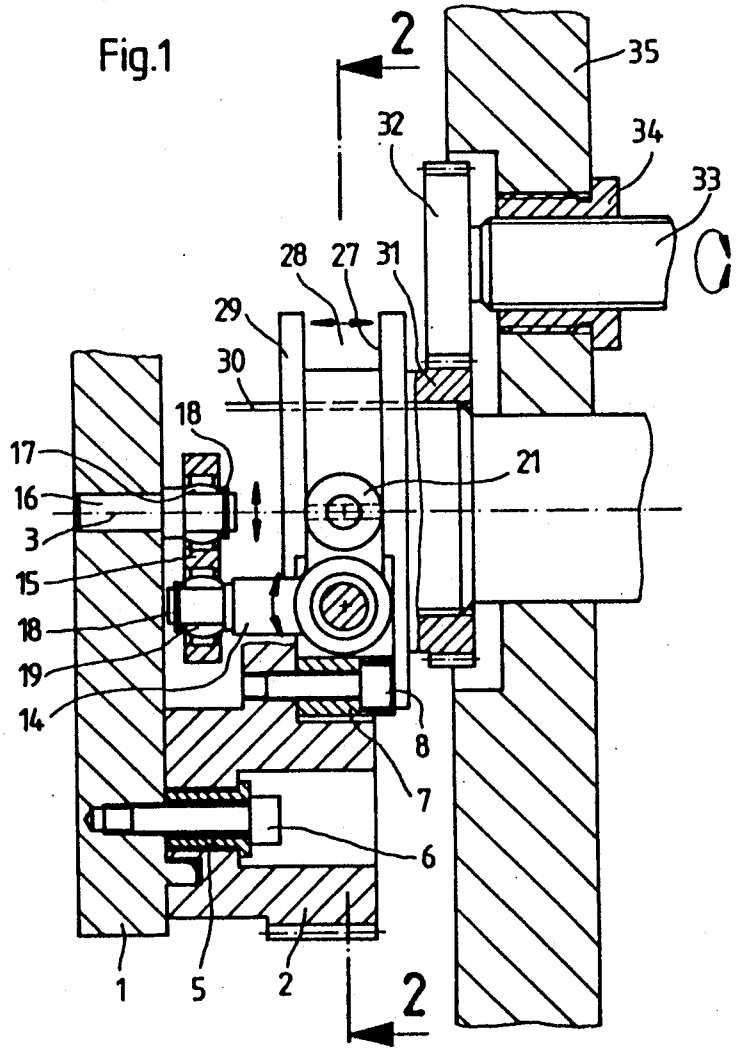

The invention relates to a device for adjusting the circumferential register of a printing machine and, more particularly, to such a device wherein a gearwheel for driving a cylinder with which it is coaxially disposed is rotatable in angular position thereof during operation of the printing machine, over a defined angle relative to the cylinder about the common axis thereof, via adjusting elements connected to the gearwheel.

It has become known heretofore from German Published Non-Prosecuted Patent Application (DE-OS) 19 43 579 to turn a plate cylinder, via a planetary gear, through a defined rotary angle while the printing machine is in operation, so as to adjust the circumferential register of the plate cylinder. A disadvantage thereof is that additional gearwheels which are expensive and bulky must be provided.

German Patent 12 90 941 discloses a device for circumferentially adjusting two cylinders, wherein plate cylinders are driven by helical gearwheels, and an axial adjustment of one of the gearwheels causes a slight turning of the plate cylinder. This construction has the disadvantage that the adjustment can be effected only within a very limited range.

According to another construction in the prior art, one of a plurality of gearwheels serving for a synchronous drive meshes with a pinion for adjusting the circumferential register between a blanket cylinder and an impression cylinder, the adjustment being achieved via a disengaging clutch (German Published Non-Prosecuted Application DE-OS 16 11 195). Due to the required switching or control operation at the clutch, this construction is hardly suited for a continuous and precise adjustment.

The construction disclosed in German Patent 10 77 231 includes a gearwheel for driving a plate cylinder, the gearwheel having a toothed rim which is rotatable with respect to the hub of the gearwheel, adjustable means having at least one swivellable pin radially disposed in the hub and having an eccentric head, the pin having a bearing which is axially guided in a member firmly connected to the toothed rim. A disadvantage of this device is that, due to the principle of construction which is employed, only a limited adjusting range is afforded by the eccentric, and linearity of the adjustment is achieved only at great expense and effort.

It is accordingly an object of the invention to provide a device for adjusting the circumferential register of a printing machine permitting a substantially proportional and continual adjustment within a wide adjusting range and a high degree of precision during the operation of the machine.

According to the invention the object is achieved in that a two-armed angular lever rotating with the gearwheel is provided for the angular adjustment of a gearwheel driving a cylinder, the gearwheel being co-axially disposed with respect to the cylinder. The axis of rotation of the angular lever has a fixed distance perpendicular to the cylinder axle, the first leg of the angular lever being pivotally connected to the cylinder via a connecting rod, the second leg of the angular lever being fastened to the end of a cam roller, the axis of rotation of the cam roller being perpendicular to the cylinder axle. The point of connection of the angular lever on the cylinder is movable relative to the gearwheel in tangential direction. Furthermore, according to the invention, a shifting wheel being movable in direction of the cylinder axle and having a radial groove is provided outside the gearwheel, the contact surface of the cam roller abutting against lateral surface of groove.

With respect to the structure it is advantageous to develop the shifting wheel as a nut provided on the threaded axle, and to provide—outside the groove region—the shifting wheel with a toothing, with a gearwheel being in constant meshing contact with the toothing during the adjusting motion, the shaft of the gearwheel being connected to a drive for the adjustment of the circumferential register.

Other features which are considered as characteristic for the invention are set forth in the appended claims.

Although the invention is illustrated and described herein as embodied in a device for adjusting the circumferential register of a printing machine, it is nevertheless not intended to be limited to the details shown, since various modifications and structural changes may be made therein without departing from the spirit of the invention and within the scope and range of equivalents of the claims.

Figure 2:
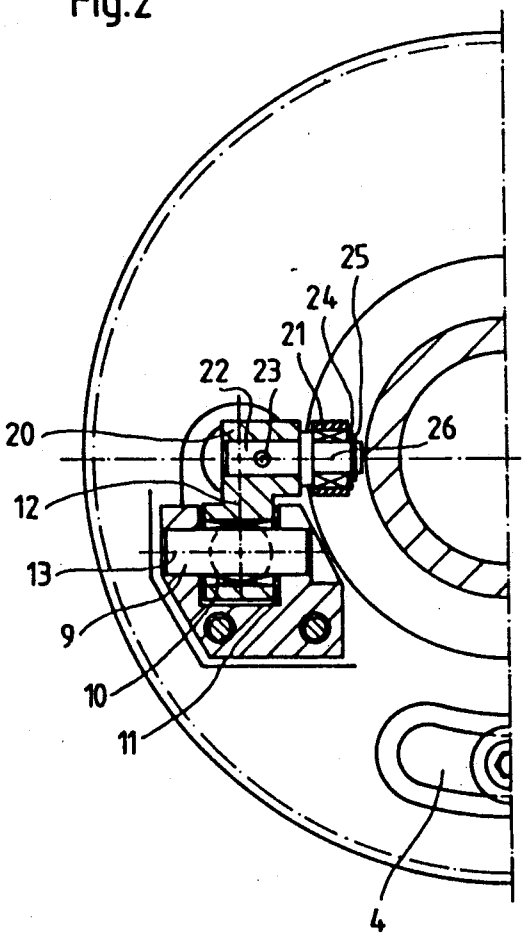

The construction and method of operation of the invention, however, together with additional objects and advantages thereof will be best understood from the following description of specific embodiments when read in connection with the accompanying drawings, in which:

FIG. 1 is a diagrammatic longitudinal sectional view of the device according to the invention; and FIG. 2 is a half-sectional view of FIG. 1 taken along the line 2—2 in the direction of the arrows.

Referring now to FIGS. 1 and 2 of the drawing, the device according to the invention is shown therein and includes a cylinder 1, only an end face plate of which is illustrated, connected to a gearwheel 2 which imparts rotary motion to the cylinder 1 about its axis 3. The gearwheel 2 and the cylinder 1 are disposed so as to be turnable with respect to one another about the axis 3 within an angular range of a slot 4. In axial direction, the gearwheel 2 is mounted on the end face of the cylinder 1 and on a collar of a bushing 5 which is fastened to the cylinder 1 by means of a clamping bolt 6. A bearing bracket 7 is secured to the gearwheel 2 by means of screws 8. An angle lever or bellcrank 12 is swivellably mounted, without play, in the bearing bracket 7 by means of a pin 9, a roller bearing 10 and discs 11. The angle lever 12 has a swivel axis 13 spaced a fixed distance from the axis 3 of the cylinder 1. One leg 14 of the angle lever 12 is connected to the cylinder 1 via a connecting rod 15. For this purpose, a bolt 16 is secured in the cylinder 1, with one end thereof projecting freely from the cylinder 1 and being held in a first calotte-type bearing 17 secured by means of a retaining ring 18 and seated in the connecting rod 15. Likewise, an end of the leg 14 is secured by means of a retaining ring 18 in a second calotte-type bearing 19 in the connecting rod 15. A cam roller 21 is attached to the second leg 20 of the angle lever 12 by means of pins 22 and 23 and discs or washers 24 and 25, and has an axis of rotation 26 which is perpendicular to the axis 3 of the cylinder 1. The cam roller 21 engages a lateral surface 27 of a recess 28 provided in a shifting wheel 29. The recess 28 is slightly wider than the diameter of the cam roller 21. The shifting wheel 29 has an internal thread and is seated as a nut on a threaded projection 30 forming part of a shaft of the cylinder 1. On a side facing away from the cylinder 1, the shifting wheel 29 is constructed as a gearwheel 31 which forms, together with a further gearwheel 32, a gear transmission. A shaft 33 is swivellably mounted in a threaded bushing 34 provided in a side wall 35 of the printing machine. The shaft 33 and the threaded projection 30 have thread pitches which differ in amount from one another. With a suitable selection of a respective transmission from the gearwheel 32 to the gearwheel 31 and the two thread pitches which are on the shaft 33 and the threaded projection 30 and are adapted to the transmission, the axial adjusting paths of the gearwheel 32 and the gearwheel 31 are identical with respect to the adjusting movement. This has the advantage that both of the gearwheels 31 and 32 may have the same width. The shaft 33 is coupled with a non-illustrated drive for adjusting the circumferential register.

The operation of the device is described hereinafter:

When the shaft 33 is set into rotation on the drive side, rotary motion is transmitted to the shifting wheel 29 via the gearwheels 31 and 32. The gearwheels 31 and 32 and the shifting wheel 29 are shifted simultaneously with the rotary motion in the direction of the axis 3, and the threads on the threaded projection 30 and the shaft 33 act upon the shaft of the cylinder 1. Because the cam roller 21 remains in constant engagement within the recess 28 of the shifting wheel 29, even when the printing machine is in operation, the shifting motion exerts a force upon the second leg 20 of the angle lever 12 so that the latter performs a swivelling movement about the swivel axis 13 thereof. Via the first leg 14 and the connecting rod 15, the gearwheel 2 exerts a force upon the cylinder 1 in tangential direction, so that the gearwheel 2 is turned with respect to the cylinder 1 about the axis 3. All movable elements are mounted so as to be free of play. The circumferential register is adjusted substantially proportionally to the rotary motion imparted by the drive. The adjusting range and the sensitivity of the device may be varied within a wide range by appropriately dimensioning the gearwheels 31 and 32, the thread pitch and the lever ratio at the angle lever 12.

The foregoing is a description corresponding in substance to German Application P 41 38 271.4, dated Nov. 21, 1991, the International priority of which is being claimed for the instant application, and which is hereby made part of this application. Any material discrepancies between the foregoing specification and the aforementioned corresponding German application are to be resolved in favor of the latter.

I claim:

1. Device for adjusting the circumferential register of a printing machine, including a gearwheel for driving a cylinder disposed coaxially therewith, adjusting elements connected to the gearwheel in angular position thereof for turning the gearwheel, during operation of the printing machine, over a defined angle relative to the cylinder about the common axis thereof, and adjusting means located outside the gearwheel and being shiftable in axial direction, said adjusting means being coupled to the adjusting elements connected to the gearwheel, the adjusting elements connected to the gearwheel comprising at least one two-armed angle lever having a swivel axis disposed perpendicularly to the axis of the cylinder at a defined distance therefrom, said angle lever having first and second legs, said first leg being swivellably connected to the cylinder via a connecting rod at a connection location movable in tangential direction relative to the gearwheel, and a cam roller fastened to an end of said second leg, said cam roller having an axis of rotation extending perpendicularly to the axis of the cylinder, the adjusting means located outside the gearwheel comprising a shifting wheel having a groove disposed outside the gearwheel in the form of adjusting means, the contact surface of the cam roller abutting against a radial lateral surface of the groove.

2. Device according to claim 1, wherein the axis of the cylinder has a thread, the shifting wheel is a nut on the thread, said shifting wheel has a side with toothing being in constant meshing contact with a gearwheel having a shaft being connected to a drive for adjusting the circumferential register, and the shifting wheel and gearwheel have identical adjusting paths.

* * * * *